US005951107A

United States Patent [19]

Tornero

[11] Patent Number: 5,951,107

[45] Date of Patent: Sep. 14, 1999

[54] HEIGHT ADJUSTING DEVICE WITH AUDIBLE FEEDBACK

[76] Inventor: Lino E. Tornero, 809 Quailmeadow Ln., Colfax, N.C. 27235

[21] Appl. No.: 09/181,208

[22] Filed: Oct. 28, 1998

[51] Int. Cl.[6] ..... A47C 7/40; A47C 7/54

[52] U.S. Cl. ..... 297/353; 297/411.36; 403/105

[58] Field of Search ..... 297/411.36, 353; 403/105, 106, 107, 109.1; 248/161, 408

[56] References Cited

U.S. PATENT DOCUMENTS

| | | | |
|---|---|---|---|
| 4,043,592 | 8/1977 | Fries . | |
| 4,451,084 | 5/1984 | Seeley | 297/353 |
| 4,639,039 | 1/1987 | Donovan | 297/353 |
| 4,660,885 | 4/1987 | Suhr et al. | 297/353 |
| 4,749,230 | 6/1988 | Tornerno | 297/353 |
| 5,586,809 | 12/1996 | Szmadzinski | 297/353 |
| 5,597,204 | 1/1997 | Karaus, Jr. | 297/353 |
| 5,649,741 | 7/1997 | Beggs | 297/353 |
| 5,678,892 | 10/1997 | Heitlinger | 297/353 X |
| 5,685,609 | 11/1997 | Miotto | 297/353 |
| 5,695,249 | 12/1997 | Lofti | 297/353 |
| 5,725,278 | 3/1998 | Verbeek | 297/353 |
| 5,765,920 | 6/1998 | Lai | 297/411.36 |
| 5,791,734 | 8/1998 | Malenotti | 297/353 |

*Primary Examiner*—Anthony D. Barfield

[57] ABSTRACT

A height adjusting device for manually positioning and automatically locking in place a chair backrest relative to a chair seat, or any other elements requiring relative positioning comprises a track member engaged with and telescoping from a support member, a lock pin and a spring. The track member is provided with guide members internally and axially disposed within the lateral faces of a cavity in the track member, so as to provide for firm yet tolerant and slideable engagement with the support member. The lock pin is trapped, yet free to move, responsive to gravity, along a cam slot in the support member, and, responsive to a spring retained on the support member produces an audible "click" when moved to a position of engagement with notches along a slot on the track member. The device is particularly tolerant where the engagement of the support member and the track member is concerned, so as to facilitate manufacture, and is therefore economical and highly reliable.

11 Claims, 5 Drawing Sheets

FIG. 8
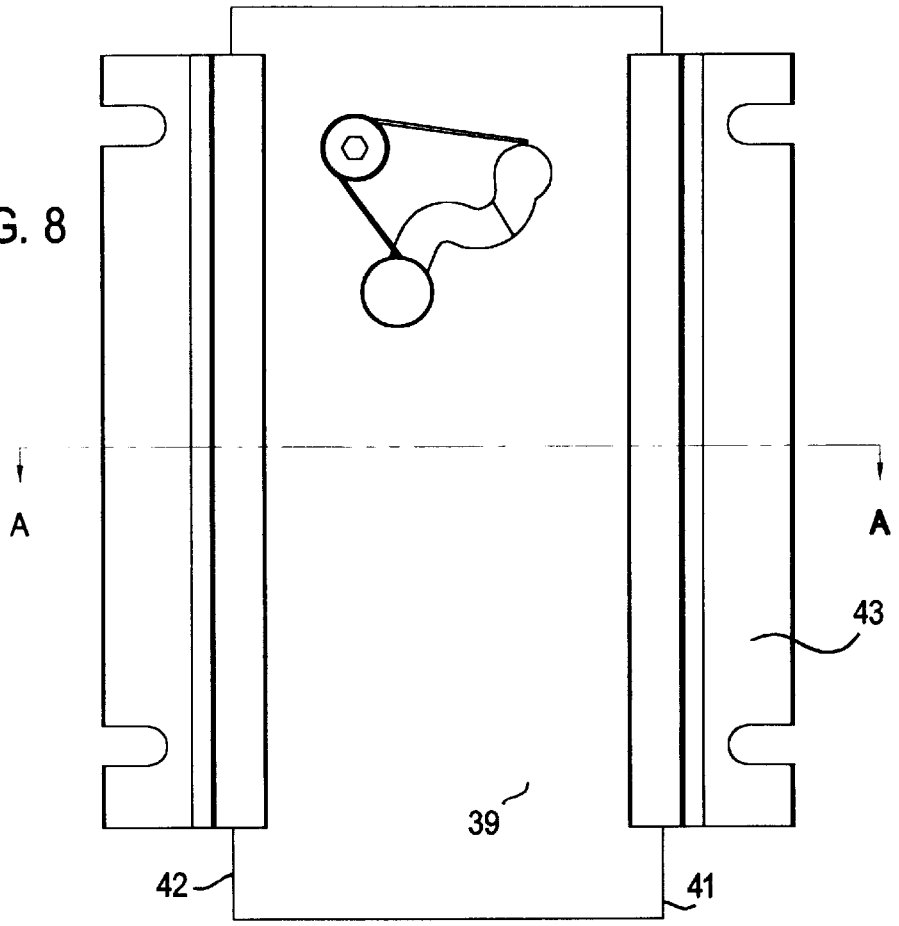
SECTION A-A
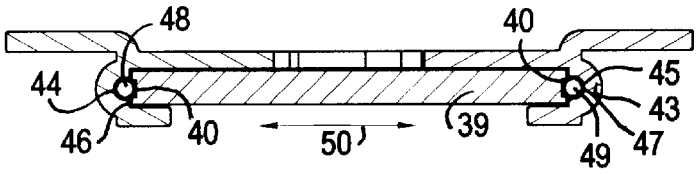
FIG. 9
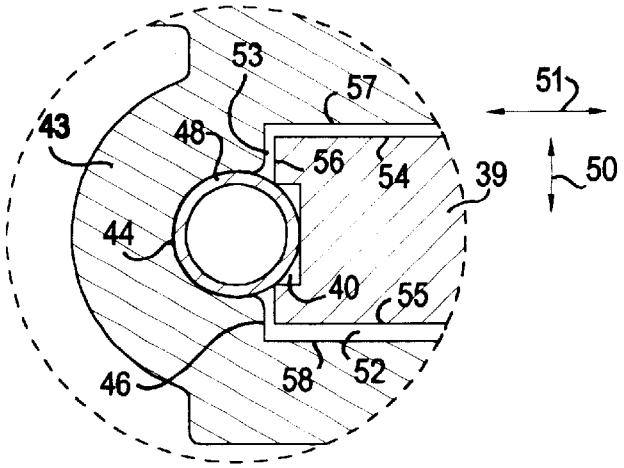
FIG. 10

HEIGHT ADJUSTING DEVICE WITH AUDIBLE FEEDBACK

BACKGROUND OF THE INVENTION

1. Field of the Invention

This invention pertains to a device that provides for the selective adjustment and positioning of components relative to one another, particularly chair backs.

2. Description of The Prior Art and Objectives of the Invention

In the prior art, such as is specified in my U.S. Pat. No. 4,749,230, which is herein incorporated by reference, a device telescopes responsive to manual control and automatically, yet releasably locks in place responsive to the effect of gravity upon a locking pin. While such devices are reliable, economic and provide quick response, they do not provide substantial audible feedback to the user as to its current state. This has been found to be highly disconcerting to most chair occupants. In that regard, it has been found that users prefer a device that produces an audible "click" alerting the user that the device has engaged, or "locked" in a given position within its intended telescoping range. The problem is analogous to a "ON-OFF" button; most people expect and prefer a "click" indicating that a change in status has taken place. One object of the present invention is to provide such a mechanism with substantial audible feedback.

Another problem in devices that are gravity dependent is that they are not suitable for releasably locking two telescoping members, if not vertically oriented, where a great deal of movement is expected, or where, for example, the device is operated horizontally. A second object of the invention is therefore to address those situations. To that end, the improved device is provided with a spring, to forcibly propel the lock pin toward a position of engagement with a notch in the track member, producing a clearly audible "click", and insuring engagement of the lock pin in all sorts of orientations. The resulting combination, a gravity operated lock pin, along with a spring, provides a great degree of reliability in all sorts of situations, yet by virtue of its design, it is highly economical to manufacture.

One other problem encountered in the prior art is the need to make the telescoping members with a high degree of precision in order to obtain a snug fit that minimizes play between the members. Unfortunately, it is very difficult to economically make such an arrangement and obtain snug, yet smooth and responsive telescoping action; often situations arise where an interference fit has occurred, or else, a sloppy fit has been obtained resulting in a wobbly engagement. In the furniture industry, for example, all currently known devices of this type suffer from this problem. Therefore, one other object of the improved device is to provide for economically and reliably facilitating the smooth telescoping action of the elements and yet insure a snug fit, free of excessive play. Therefore, this object of the invention consists of providing several internal cavity faces on the track member with fixed and longitudinally disposed guide members, so that the support member telescopes in what is known in the art as a "running fit". These guide members are made of a resilient material such as nylon, and may be shaped like tubes. By judiciously selecting the wall thickness and durometer of the tubes, these guides can be made to automatically compensate for tolerance requirements between the track member and the support member. Alternatively, the support member may be grooved on its narrow sides so as to engage corresponding guide members in a "tongue-in-groove" or "keyed" like arrangement. The support member would therefore be able to telescope within the track member in a guided yet resilient fit across the longitudinal axis and across the transverse axis of the device simultaneously. In that manner, the track member can telescope snugly along the entire adjustment stroke of the device. If the support member happens to be manufactured slightly larger (or smaller) in width than optimally specified, the guide members will automatically deform to compensate. It should be realized that even a small departure from the optimal dimensions of any telescoping device, often only a few thousandths of an inch, can cause other elements attached to such a device to wobble unacceptably and breakage or binding may result. Wobbling of a chair back is very annoying and distracting to a chair occupant, so in this type of device, it is imperative to keep it to a minimum. In this embodiment of the improved device, the support member is kept from all manner of contact with the track member and is in contact only with the guide members. Therefore, the device is unlikely to bind, and will also be more tolerant to twists or deflections of the track member, which may occur during installation.

The device is extremely easy to operate. When used to adjust the height of a chair back relative to the chair seat, all the user needs to do is, while in the seated position, reach with the hands and lift the chair back to the next desired position. At that point, if the user lets go of the chair back, the device will automatically lock in that position and remain there until adjustment is again required. The device can be made to cycle from one uppermost position to one lowermost position by the biasing action of the cam slot in the support member and the locking action of the notches of the cam slot in the track member upon the locking pin.

These and other objectives and advantages will become readily apparent to those skilled in the art upon reference to the following detailed description and accompanying drawing figures.

SUMMARY OF THE INVENTION

The aforedescribed objectives and advantages are realized by providing a chair or similar item which includes a support member, said support member defining a sinuous support cam slot. This support member is slidably received by a track member which is affixed to the chair back in the preferred embodiment. The track member also defines a cam slot, which defines a plurality of notches. A lock pin releasably affixes said support member to said track member in one of a plurality of positions. A spring biases the lock pin against the notches of the track cam slot and produces audible clicks as the track member ratchets up and down the support member. Resilient polymeric tubes are positioned between the support member and the track member to improve the track to support fit. The resilient tubes deform to a shape which insures an optimum fit, even if the tolerances would otherwise create wobbly furniture or the like.

BRIEF DESCRIPTION OF THE DRAWINGS

FIG. 8 illustrates a back view of an alternate embodiment of the present invention;

FIG. 9 demonstrates a cross-sectional view along lines A—A of FIG. 8; and FIG. 10 pictures an enlarged view of a portion of FIG. 9.

DETAILED DESCRIPTION OF THE PREFERRED EMBODIMENT AND OPERATION OF THE INVENTION

The objects of the invention can be achieved in an advantageous manner by the arrangement of elements shown in the accompanying drawings of which the following is a detailed description.

Figure 1:
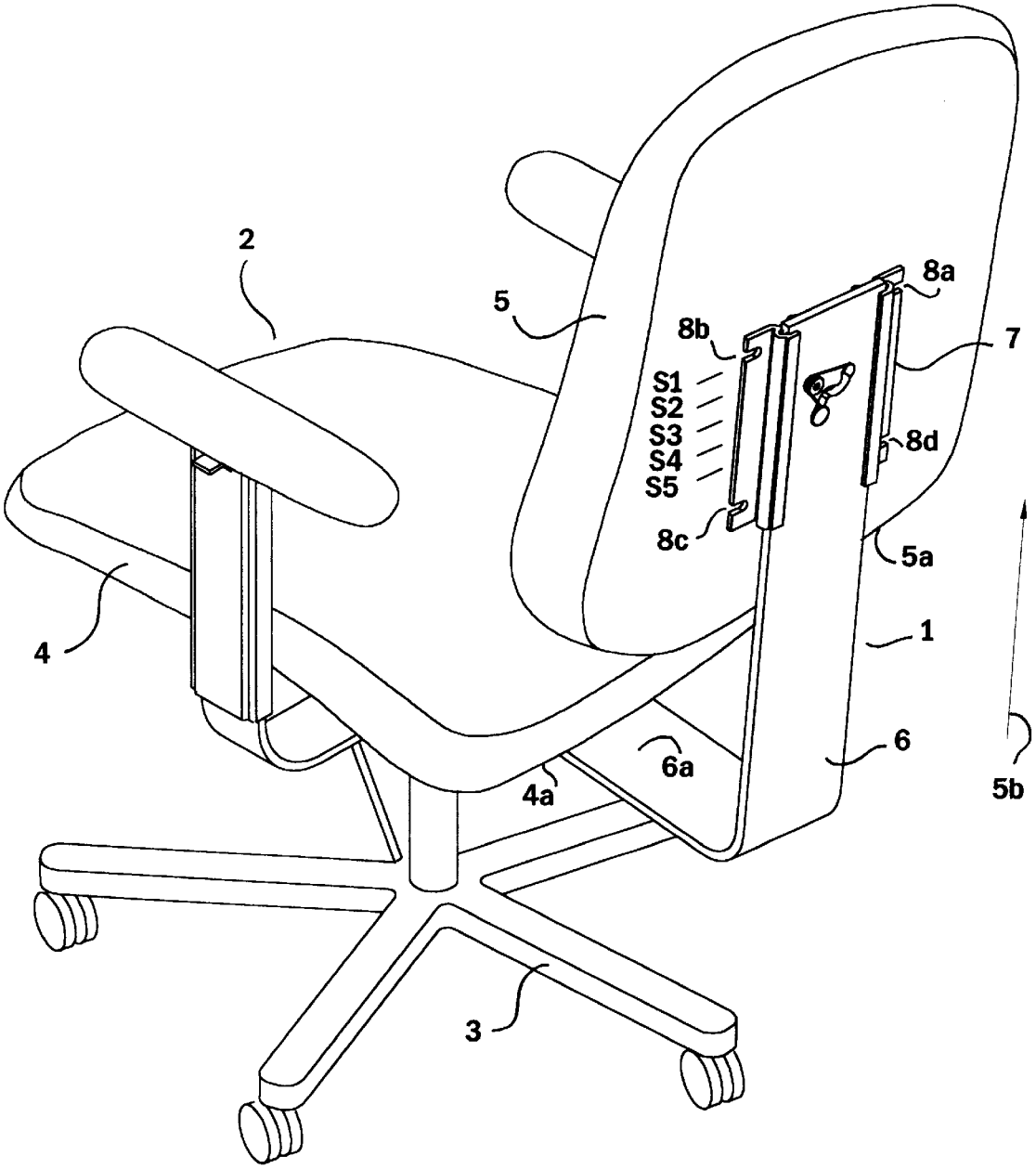
FIG. 1 shows a perspective view of the back of a chair with the device of the present invention installed thereon.
Figure 2:
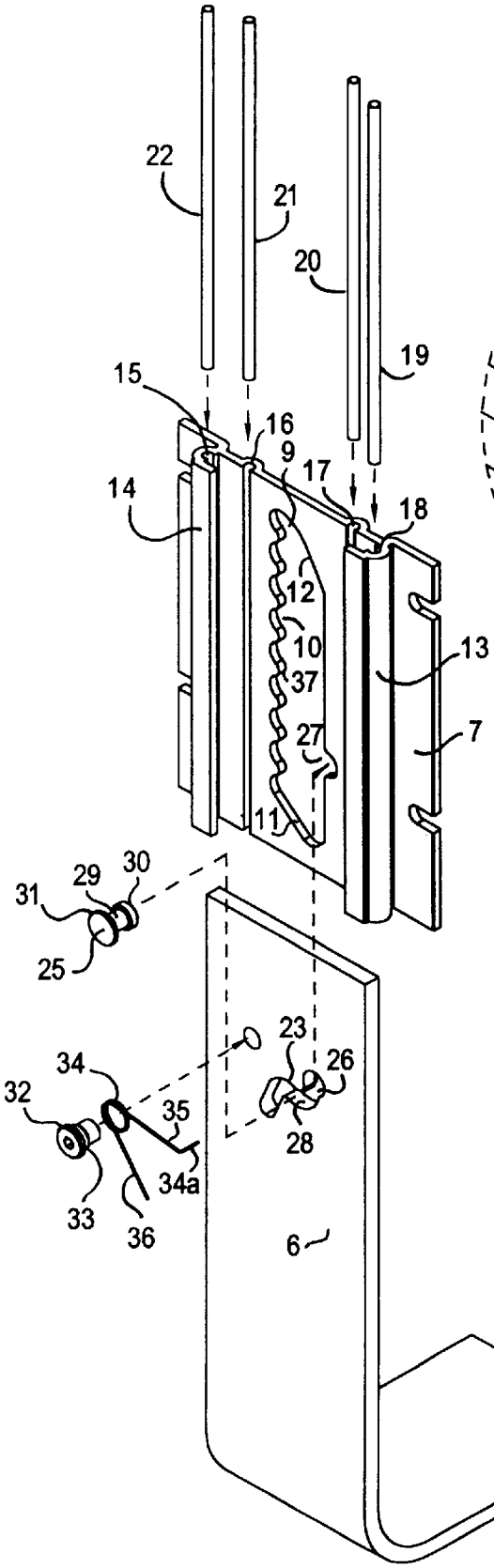
FIG. 2 illustrates an enlarged, exploded view of the device of FIG. 1, removed from the chair.

Referring to FIGS. 1 and 2, device 1 and object of invention is seen installed on chair 2. Chair 2 comprises support base 3, seat with armrests 4, and back 5. Back 5 is connected to seat 4 by means of device 1. Device 1 allows a chair occupant (not shown) to vertically position chair back 5 relative to seat 4 in any of a plurality of steps S1, S2, S3, S4 or S5. The number of said steps being arbitrarily chosen for convenience, and corresponding to the number of notches 10 provided in cam slot 9.

Device 1 comprises support member 6, track 7 secured to back 5 by means of mounting slots 8*a*, 8*b*, 8*c* and 8*d* and bolts or screws (not shown). Track 7 includes first or track cam slot 9. Cam slot 9 is provided with series of notches 10, and cam surfaces 11 and 12. Track 7 is also provided with laterally disposed channels 13 and 14 for telescopingly mating with support member 6, and channels 15, 16, 17 and 18 into which are inserted guides 19–22 respectively. Support member 6 is telescopically received within channels 13 and 14 of track 7 in slidably contact with guides 19–22. Support member 6 is provided with second or support cam slot 23. Lock pin 25 is inserted through cavities 26 and 27 and is allowed to freely engage cam surface 28 about lock pin neck 29, yet is restricted from axial displacement by shoulders 30 and 31. Spring post 32 is provided with neck 33 for receiving spring 34 and is fixed to support member 6.

Figure 4:
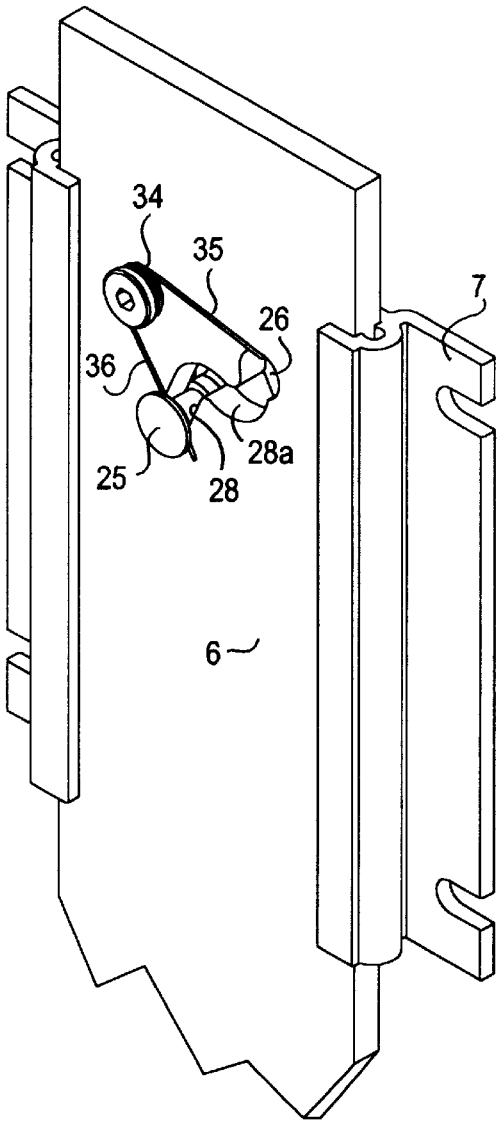
FIG. 4 features a perspective view of the back of the device showing the location of the lock pin while the device is at an intermediate position.

Referring now also to FIG. 4, spring 34 is provided with two angularly disposed legs 35 and 36. Leg 35 of spring 34 has short section 34*a* bent at an angle for insertion into cavity 26. Thus, movement of spring leg 36 is possible, while leg 35 is substantially fixed. Leg 36 is disposed so as to engage with and provide constant pressure upon lock pin 25. Thus, lock pin 25 is able to slide on cam go surface 28 responsive to telescoping movement of track 7 about support member 6 and the biasing force of teeth 37.

Figure 3:
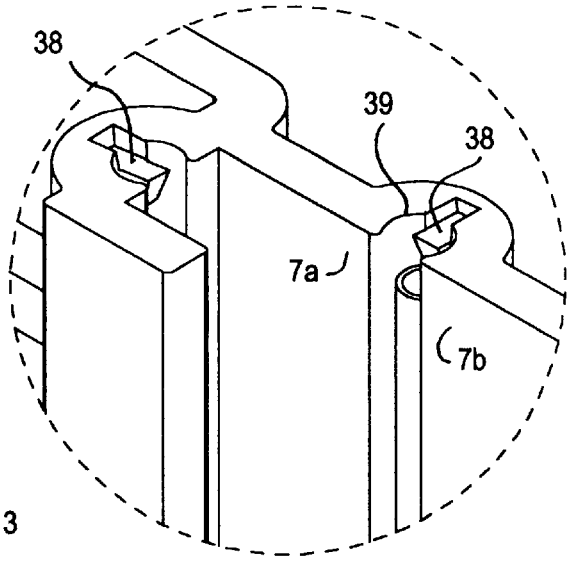
FIG. 3 demonstrates an enlarged view of the tracks on the device of FIG. 2.

Referring now to FIGS. 2 and 3, guides 19–22 are retained and prevented from axial displacement by deformations 38 suitably designed and arbitrarily located around the periphery of ends 39 of channels 15–18. Thus, making a substantially small portion on the ends of channels 15–18 exhibit a cross-sectional area smaller than the overall cross-sectional area of guides 19–22. Deformations 38 may be of any suitable configuration that is effective in constricting the ends of channels 15–18 without substantially deforming or affecting the flatness of surfaces 7*a* and 7*b*.

Referring now to FIGS. 8–10, an alternate embodiment of the device includes alternate support member 39, which is provided with longitudinally disposed grooves 40 along both lateral faces 41 and 42. Alternate track member 43 has guide channels 44 and 45 longitudinally disposed along the entire length of opposing faces 46 and 47 for receiving and retaining guides 48 and 49. Grooves 40 of support member 39 engage guides 48 and 49 and substantially prevent displacement of support member 39 along directions 50 and 51 so as to insure that there are substantial gaps 52 and 53 at all times between faces 54–56 of support member 39 and faces 57, 58 and 46 of track member 43. Support member 39 is thus capable of telescoping freely within track member 43.

INSTALLATION AND OPERATION OF THE DEVICE

Referring to FIG. 1, device 1 may be installed on chair 2 by bolting track member 7 to chair back 5. Support member 6 has transverse portion 6*a*, which is fixedly attached to underside 4*a* of chair seat 4 by suitable means, which may very depending on the chair design.

Figure 5:
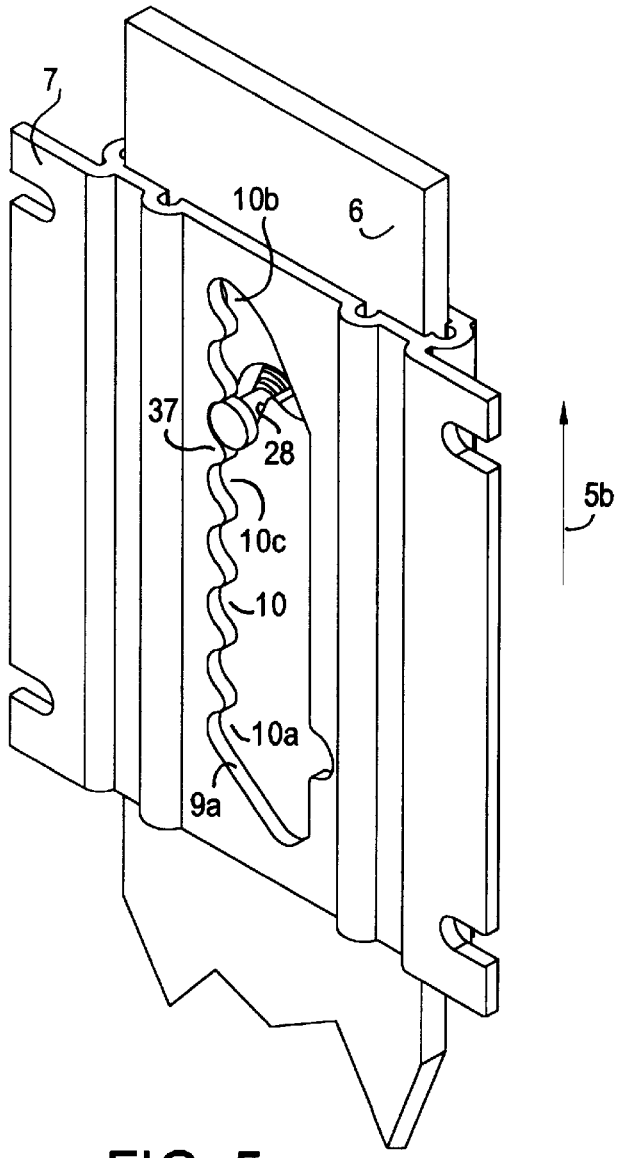
FIG. 5 pictures a perspective view of the front of the device of FIG. 4.
Figure 6:
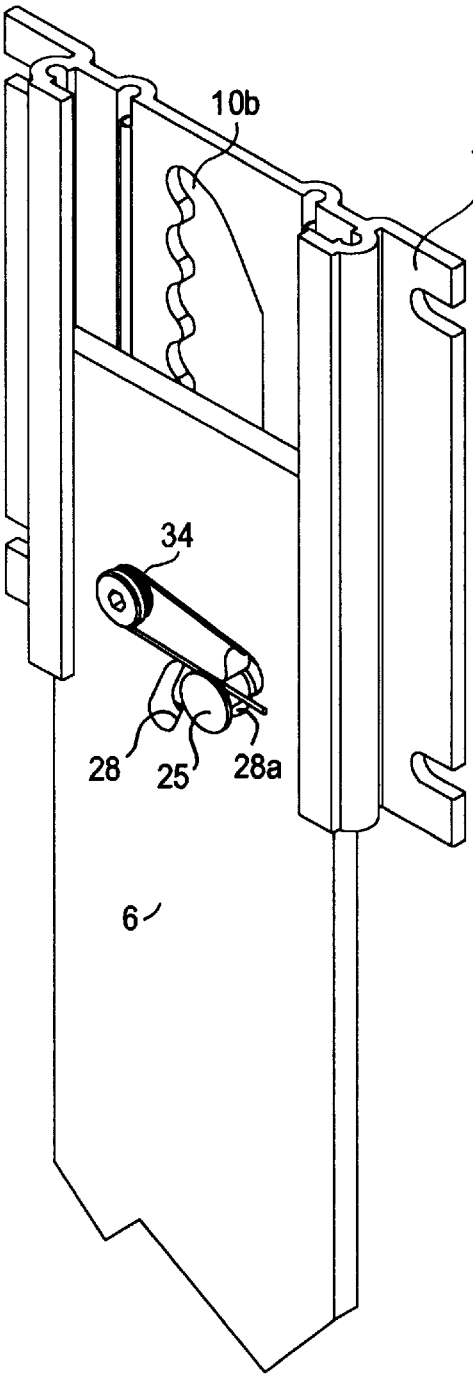
FIG. 6 depicts a perspective view of the back of the device showing the lock pin in the standby position.
Figure 7:
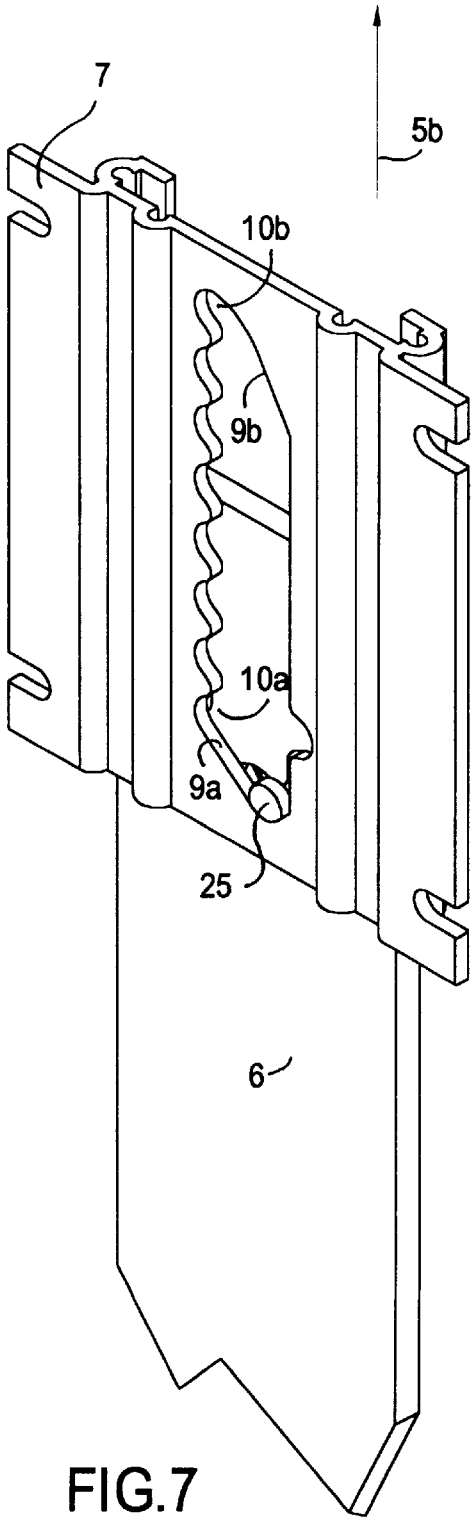
FIG. 7 shows a perspective view of the front of the device of FIG. 6.

Referring now also to FIGS. 4 and 5, to operate device 1, a person (not shown) need only reach with one or both hands (not shown) and holding chair back 5 anywhere along bottom portion 5*a* exert an upward force 5*b*. Upward force 5*b* will cause track member 7 to slide about support member 6 and will simultaneously cause tooth 37 to displace lock pin 25 for a short distance along cam surface 28 and against the biasing force of spring 34. Force 5*b* is slightly increased until tooth 37 clears lock pin 25 causing spring 34 to rapidly propel lock pin 25 back to a position of engagement with next slot 10*c*. This process may be repeated until the lock pin reaches the last notch 10*a* and at that point device 1 and chair back 5 will be at the highest position relative to support member 6 and chair seat 4. Referring now also to FIGS. 6 and 7, if force 5*b* is maintained, lock pin 25 will be displaced further along cam surface 28 by reaction to cam surface 9*a* until it rests on cam surface 28*a*. Meanwhile, spring 34 is fully deflected. If, at this point, force 5*b* is removed, track member 7 and chair back 5 will displace downwards, responsive to gravity or user manipulation, and lock pin 25 will make contact with cam surface 9*b*. If downward motion is maintained, cam surface 9*b* will cause lock pin 25 to engage cam surface 28, spring 34 will rapidly propel lock pin 25 to a position of engagement with first notch 10*b*. At this point, device 1 and chair back 5 will be at a lowest position relative to support member 6 and chair seat 4. The process may be repeated and selectively interrupted, allowing lock pin 25 to engage any of notches 10 in cam slot 9. Every time the bias force of spring 34 upon lock pin 25 causes it to be propelled along cam surface 28, lock pin 25 will make contact with tooth 37 producing an audible sound or "click" which alerts the user device 1 has attained a new position.

The preceding recitation is provided as an example of the preferred embodiments and is not meant to limit the nature of scope of the present invention or appended claims.

I claim:

1. In a device for positionally adjusting and releasably locking a chair backrest in any of a plurality of positions including a support member; a track member, said support member slidably received by said track member; and means for releasably locking said track member to said support member, said locking means including a cam slot, said cam slot having a plurality of notches along one side, a support cam slot, said support cam slot having a plurality of cam surfaces, and a lock pin, said lock pin engaged within said support cam slot, said lock pin being responsive to displacement of said track member relative to said support member and being releasably engageable with said notches, the improvement comprising:

a resilient tube, said tube positioned between said support member and said track member.

2. The device of claim 1 further comprising a spring, said spring biasing said lock pin.

3. The device of claim 1 further comprising a spring post, said spring post affixed to said support member.

4. The device of claim 3 further comprising a spring, said spring held contiguous to said support member by said spring post.

5. The device of claim 4 wherein said spring comprises a first leg, said first leg stationary relative to said support member.

6. The device of claim 5 wherein said spring comprises a second leg, said second leg biasing said lock pin downwardly within said support cam slot.

7. In a device for releasably locking a structural member in any of a plurality of positions relative to a support structure including a support member, a track member, said support member slidably received by said track member, and locking means for releasably locking said track member and said support member in positions responsive to manual movement of said support member, said locking means including a cam slot, said cam slot having a plurality of notches along one side, a sinuous support member cam slot, a lock pin, said pin within said support member cam slot, said lock pin being responsive to displacement of said support member relative to said track member to a locked position within a first notch on said cam slot, and said lock pin movable to an unlocked position by further displacement of said support member relative to said track member, the improvement comprising:

a resilient member, said resilient member positioned on said track member, said resilient member contiguous to said support member.

8. The device of claim 7 further comprising a spring and a spring post, said spring post retaining said spring contiguous to said support member.

9. The device of claim 7 further comprising a resilient tube, said tube positioned on said track member.

10. The device of claim 7 wherein said resilient member is a tube.

11. The device of claim 10 wherein said tube extends vertically along said track member.

* * * * *